US009482037B2

(12) United States Patent
Graute et al.

(10) Patent No.: US 9,482,037 B2
(45) Date of Patent: Nov. 1, 2016

(54) EXTERIOR LOCKING MODULE FOR A LOCK

(71) Applicant: Kiekert Aktiengesellschaft, Heiligenhaus (DE)

(72) Inventors: Ludger Graute, Essen (DE); Heiko Hemmer, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 0 days.

(21) Appl. No.: 14/363,910

(22) PCT Filed: Dec. 6, 2012

(86) PCT No.: PCT/DE2012/001179
§ 371 (c)(1),
(2) Date: Jun. 9, 2014

(87) PCT Pub. No.: WO2013/083115
PCT Pub. Date: Jun. 13, 2013

(65) Prior Publication Data

US 2014/0352373 A1 Dec. 4, 2014

(30) Foreign Application Priority Data

Dec. 9, 2011 (DE) ..... 10 2011 120 885

(51) Int. Cl.
*E05B 17/04* (2006.01)
*E05B 85/06* (2014.01)
(Continued)

(52) U.S. Cl.
CPC ..... *E05B 85/06* (2013.01); *E05B 15/004* (2013.01); *E05B 17/041* (2013.01); *E05B 17/047* (2013.01); *E05B 63/0017* (2013.01); *E05B 85/02* (2013.01); *Y10T 70/7486* (2015.04)

(58) Field of Classification Search
CPC .... E05B 17/04; E05B 17/041; E05B 17/047; E05B 17/0058; E05B 63/0017; E05B 85/06; E05B 15/004; E05B 85/02; B60R 25/007; B60R 25/0023; B60R 25/04; B60R 25/02142; B60R 25/2063
USPC ..... 70/237, 252, 379 R, 379 A, 380
See application file for complete search history.

(56) References Cited

U.S. PATENT DOCUMENTS 2,605,631 A 8/1952 Jacobi
2009/0314045 A1* 12/2009 Giacomin et al. ..... 70/237
(Continued)

FOREIGN PATENT DOCUMENTS

DE 10017439 A1 10/2001
DE EP1279783 A1 * 7/2002 ..... E05B 17/04
(Continued)

OTHER PUBLICATIONS

Machine Translation of DE10017439A1 (Jun. 2, 2014) by Lexis Nexis Total Patent.
(Continued)

*Primary Examiner* — Suzanne Barrett
*Assistant Examiner* — Morgan McClure
(74) *Attorney, Agent, or Firm* — Woodard, Emhardt, Moriarty, McNett & Henry LLP

(57) ABSTRACT

The invention relates to a module for locking a motor vehicle lock. The aim of the invention is to design an easy-to-make and compact locking module for a lock. Said aim is achieved by a locking module comprising a housing, a switching nut that can be connected to a locking cylinder so as to rotate the switching nut by means of a key, and mechanism for converting a rotary movement of the switching nut into a linear movement to lock and unlock a lock. The mechanism comprises a dog which is linearly moved by a rotary movement of the switching nut. In the mounted state of the locking module, the linear movement of the dog actuates a mechanism that causes the lock to unlock or lock. In order to minimize the number of parts, the switching nut is rotatably mounted by the module housing.

20 Claims, 3 Drawing Sheets

(51) Int. Cl.

| | |
|---|---|
| ***E05B 15/00*** | (2006.01) |
| *E05B 63/00* | (2006.01) |
| *E05B 85/02* | (2014.01) |

(56) References Cited

U.S. PATENT DOCUMENTS

| | | | | |
|---|---|---|---|---|
| 2011/0107800 | A1* | 5/2011 | Barbier et al. | 70/101 |
| 2011/0120198 | A1* | 5/2011 | Monig | B60R 25/02153 70/252 |
| 2011/0179834 | A1 | 7/2011 | Mahaffey et al. | |
| 2011/0179835 | A1* | 7/2011 | Tabe et al. | 70/106 |
| 2011/0187129 | A1* | 8/2011 | Graute | 292/2 |
| 2012/0000257 | A1* | 1/2012 | Wheeler | E05B 15/102 70/91 |
| 2014/0291999 | A1* | 10/2014 | Graute et al. | 292/96 |

FOREIGN PATENT DOCUMENTS

| | | | |
|---|---|---|---|
| DE | 10230586 | A1 | 1/2004 |
| EP | 1279783 | A1 | 7/2002 |
| EP | 1482111 | A2 | 12/2004 |
| GB | 2193527 | A | 2/1988 |
| JP | 2004049549 | A | 7/2002 |

OTHER PUBLICATIONS

Machine Translation of DE10230586A1 (Jun. 2, 2014) by Lexis Nexis Total Patent.

Machine Translation of EP1279783A1 (Jun. 2, 2014) by Lexis Nexis Total Patent.

Machine Translation of JP2004049549A (Jun. 2, 2014) by Lexis Nexis Total Patent.

* cited by examiner

EXTERIOR LOCKING MODULE FOR A LOCK

BACKGROUND

The invention relates to a module for locking a motor vehicle lock.

A lock for a motor vehicle or a building contains a locking mechanism comprising a pivotable rotary latch and at least one pivotable pawl for latching the rotary latch. Such a lock is used for temporary locking openings in motor vehicles or buildings with the aid of doors or flaps. In the closed state of such a lock, the rotary latch reaches around the generally bow-shaped striker—also referred to as lock holder—which in case of a motor vehicle is generally mounted on the car body. Once the rotary latch reaches a closed position after pivoting from an open position, the rotary latch is then latched by a pawl. The rotary latch can then no longer be returned to the open position and the striker can no longer leave the locking mechanism. To open the lock, the pawl must be moved out of its detent position.

Such a lock is generally connected to a locking cylinder and handle by means of a mechanism. By operating the handle a latched locking mechanism can be released in order to open an associated door or flap. With the aid of the locking cylinder, a locking module can lock the door or flap in such a way that it can no longer be opened by activation of the handle. Module in the sense of the invention means that the seat of at least the switching nut is arranged in a single or multi-part separate housing. Separate housing in turn means that the door lock on which the module can be mounted contains at least another housing part. A locked door or flap must first be unlocked again to be able to subsequently open the door or flap again. The locking module transmits the rotary movement of a key onto a mechanism, which in the closed state prevents the locking mechanism from being released by the operation of a handle, allowing the door or flap to be subsequently opened.

Publication DE 101 52 618 A1 discloses a lock for a motor vehicle containing a locking cylinder and a handle. A locking cylinder contained in an external handle is connected to a key rotor by means of a rod. A rotary movement of the key is transmitted by the locking cylinder onto the key rotor. A respective rotary movement of the key rotor is transmitted onto a lever mechanism causing the vehicle door to be opened or locked by its rotation. An actuation of the external handle can be transmitted on the locking mechanism for unlocking with the aid of a rod.

Publication US 2011/0179835 A1 discloses a door with a latch for a motor vehicle, which can be locked or unlocked by a key and locking cylinder. A rotary movement of a key in a locking cylinder is transmitted onto a closing mechanism by a transmission mechanism in order to be able to unlock or lock the door of a motor vehicle.

SUMMARY

The invention has the task of providing an easy-to-make, highly reliable and compact locking module for a lock. The task is solved by a locking module with the characteristics of the first claim. Advantageous embodiments are described in the sub-claims.

To solve this task, a locking module is provided with a housing, a switching nut that can be connected to a locking cylinder for rotating the switching nut by means of a key and a mechanism for converting a rotary movement of the switching nut into a linear movement to lock and unlock a lock. The mechanism comprises a dog, which is linearly moved by a rotary movement of the switching nut. If in the mounted state of the locking module the switching nut is turned by the rotation of a locking cylinder connecting to a switching nut by means of a key, this rotary movement is converted by the mechanism into a linear movement of the dog. In the mounted state of the locking module the linear movement in turn activates a mechanism causing the release or unlocking or latching or locking of the lock.

The switching nut is rotatably mounted by means of the housing. The housing thus provides a bearing accommodating the switching nut and providing the rotatable mounting of the switching nut. This keeps the number of parts required for providing a locking module to a minimum. It also makes production technically easier and offers the advantage of a high level of reliability. Reliability is in particular ensured as the switching nut is mainly accommodated in the housing.

In one embodiment, the mechanism contains a transmission lever, transmitting a movement of the switching nut onto the dog. Advantageously the transmission lever is designed in such a way that a rotary movement of the switching nut causes the transmission lever to turn. The transmission lever is also connected to the dog in such a way that a rotation of the transmission lever produces a linear movement of the dog. The transmission lever advantageously allows the provision of additional functions and/or of particular configurations.

In one embodiment, a neutral position is provided between the switching nut and the dog. The neutral position ensures that a rotation of the switching nut does not necessarily cause an immediate linear movement of the dog. Accidental turning of the key does therefore not cause the lock to immediately lock or unlock. Only after passing through the neutral position does a further turning of the key result in a linear movement of the dog and thus locking or locking of an associated lock.

A suitably large neutral position during a rotary movement of a switching nut of nearly up to 120° can be achieved particularly easily between the switching nut and the transmission lever. In one embodiment a particularly cylindrical or conical lateral surface of the switching nut advantageously extends at least partially into an in particular cylindrical or conical lateral surface. The external circumference of the lateral surface of the switching nut therefore contains a stop, which by turning the switching nut can be moved against a stop arranged on the internal circumference of the lateral surface of the transmission lever. When the stop of the switching nut has been moved against the stop of the transmission lever by rotating the switching nut, further turning of the switching nut causes a rotary movement of the transmission lever. As long as the stop of the switching nut has not been moved against the stop of the transmission lever by the rotation of the switching nut, the transmission lever does not rotate together with the switching nut. A neutral position has thus been provided between the switching nut and the transmission lever.

This neutral position can also be provided by the lateral surface of the transmission lever extending at least partially into the lateral surface of the switching unit. In this case, one stop is provided on the outside of the lateral surface of the transmission lever and one stop on the inside of the lateral surface of the switching nut.

It is also possible to provide such stops on for instance the end faces of switching nut and transmission lever in order to attain a wide neutral position. It is, however, preferred that the switching nut extends into the transmission lever as described or vice versa, in order to achieve a good level of stability.

In one embodiment such a neutral position covers at least 20° and preferably at least 25°. In this embodiment, the switching nut must be turned by at least 20° and preferably by at least 25° before the transmission lever is also rotated. This embodiment therefore particularly reliably prevents an accidental turning of a key causing unintentional locking or unlocking of a lock. A neutral position is thus defined by the locking cylinder or key being turnable by an insertion position, i.e. a zero position, in positive and negative direction, without causing a movement and in particular a moment from the switching nut onto the transmission lever and/or the dog.

In one embodiment of the invention, the axes of rotation of the switching nut and transmission lever are arranged at an angle to each other, with the angle being less than 180°. This arrangement of the transmission lever in relation to the switching nut causes a rotary movement of the switching nut to be converted into a linear movement of the dog in a desired direction, as the selection of the angle affects the direction of movement of the dog. In this embodiment, the module can be particularly easily adapted to different installation situations.

In one embodiment, the transmission lever is rotatably mounted by the housing in order to keep the number of parts and thus production steps to a minimum.

In one embodiment, the dog is slideably mounted by the housing in order to keep the number of parts and thus production steps to a minimum.

In one embodiment, a spring is provided, which after a rotation of the switching nut returns a component of the locking module, moveable by the switching nut, into an interim position and, in particular, the transmission lever. In this way a neutral position can be provided for the transmission lever as soon as no or no excessive force acts on the transmission lever. As a result it can be reliably ensured that a neutral position remains between the switching nut and the transmission lever even when the switching nut is turned back by a key into an insertion position after unlocking or locking, in order to be able to withdraw the key from the locking cylinder in the insertion or zero position of the locking cylinder.

DETAILED DESCRIPTION OF THE DRAWINGS

Below, the invention is explained in detail with reference to figures.

Figure 1:
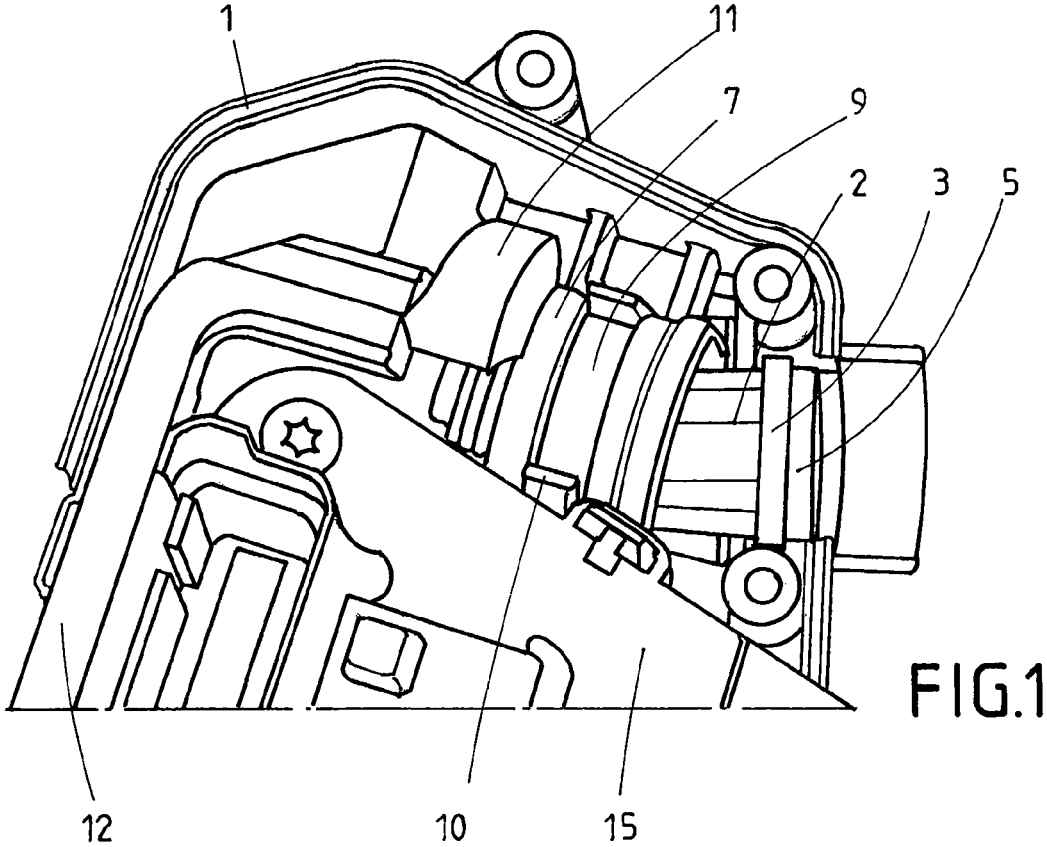
FIG. 1 is a perspective view of a locking module with half the housing removed.
Figure 2:
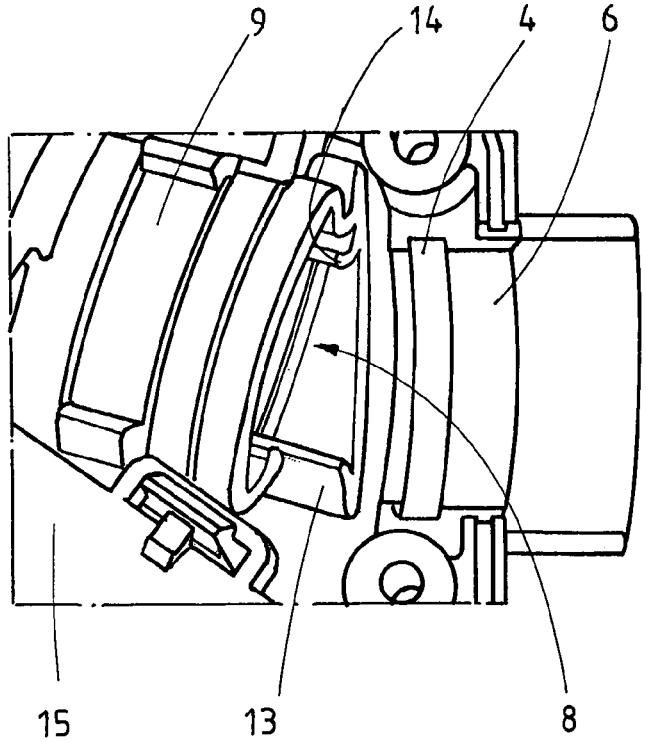
FIG. 2 is a perspective view of the FIG. 1 locking module omitting the switching nut shown in FIG. 1.

FIG. 1 shows a module for locking a lock in which half of the housing 1 has been removed, to show the inside of the module. FIG. 2 shows a section of FIG. 1 but without switching nut 2. A switching nut 2 is rotatably mounted by means of the housing 1 of which only one of two housing shells is shown in the two figures. The lateral surface of the switching nut 2 contains an area 3 protruding outwardly as a ring-like shape which extends into a ring-like groove 4 of the housing 1. Groove 4 and the protruding area 3 contribute to the switching nut being rotatably mounted by the housing 1 on one hand and being secured against dislocation, on the other hand. Such a seat of the switching nut provides functional reliability. Alternatively, the switching nut 2 can be provided with a ring-shaped groove in its outer surface into which the protruding ring of the housing 1 extends in order to rotatably mount the switching nut on one hand and secure it against dislocation, on the other hand.

In order to stabilize the rotatable mounting, the switching nut 2 contains in one embodiment of the invention at least a ring-shaped or other rotational symmetric area 5 of the lateral surface of the switching nut 2, which in one embodiment abuts the protruding area 3 and which is, for instance, rotatably retained by two inside faces 6 of the housing 1.

This rotatably mounted end section of the switching nut 2 can become or be connected through an adjacent opening in housing 1 by, for instance, a rod—not shown—which in turn is connected to a closing cylinder of a door or flap. The connection between the rod and the switching nut 2 can be provided by means of positive, frictional and/or material locking. A rotation of the locking cylinder with the aid of a key is transmitted onto the switching nut 2 by means of the rod or a similarly acting component, said switching nut being respectively turned for locking or unlocking an associated lock.

In one embodiment, the lateral surface of the switching nut 2 tapers cone-like at one end, against which a transmission lever 7 abuts. Preferably, the tapering starts from the end section connectable to a rod, in particular from the protruding area 3 and in the direction of the transmission lever 7. An end section of this tapering extends into an opening 8 of the transmission lever 7.

Transmission lever 7 is in turn rotatably mounted or held by means of housing 1. Transmission lever 7 is also secured against displacement along its axis of rotation by housing 1. In order to prevent any displacement, the transmission lever 7 can, for instance, contain a ring-shaped circumferential groove 9 on the outside of its lateral surface, into which a suitable protruding area 10 of the housing 1 extends. Areas adjacent to the groove 9 are advantageously rotationally symmetric and are rotatably held or mounted by respective housing surfaces in order to stabilize the arrangement.

As the tapered end of the switching nut 2 extends into the transmission lever 7, it is possible to position the axis of rotation of the switching nut 2 at an angle other than 180° in relation to the axis of rotation of the transmission lever 7. This means that the switching nut 2 and the transmission lever 7 cannot be arranged parallel to each other. As a result, the module can be flexibly adapted to the geometric requirements of, for instance, a motor vehicle door, by selecting a suitable angle between the two axes of rotation.

The transmission lever 7 contains a lever arm 11 flexibly connected to a dog 12 and preferably to an end section. The dog 12 is preferably slideably mounted by means of the housing 1. The connection between the lever 11 and the dog 12 is such that pivoting of the lever 11 causes a displacement of the dog 12. For this purpose, dog 12 can be L-shaped. The short end is then preferably connected to the free end of the lever 11 for sliding the dog 12 and pivoting the transmission lever 7. The connection between the lever 11 and the dog 12 preferably contains a certain play in order to be able to particularly reliably displace the dog 12 by pivoting the lever 11, pivoted by sufficient turning of the switching nut 2.

The transmission lever 7 contains two stops 13 and 14 on the internal circumference of its opening 8. A stop on the external circumference of the switching nut 2 can be moved to and fro between said two stops 13 and 14. In this way a neutral position is provided between the switching nut 2 and transmission lever 7. Preferably, the distance between the two stops 13 and 14 is chosen in such a way that the stop of the switching nut 2 can be turned from a centre position by up to +25° or −25°, without this also turning the transmission lever. Only when turned by more than 25°, does the stop of the switching nut 2 reach a respective stop 13 or 14 of the transmission lever 7, so that the transmission lever 7 is also rotated.

FIGS. 1 and 2 only show one shell of the housing 1. The housing 1 contains a further shell which can be connected to the housing shell shown in FIGS. 1 and 2 in such a way that the switching nut 2 and transmission lever 7 are completely or nearly completely arranged in the housing 1. Dog 12 is generally only partially located in housing 1. Its end protruding from housing 1 is connected to a mechanism—not shown—with which the associate lock—also not shown—can be locked or unlocked.

A mounting unit 15 can be provided inside the housing which contains one or several areas for housing electrical components and/or which contains one or several electric conductive tracks. The mounting unit 15 is preferably positively held or secured in order to minimise the number of parts and required production.

Figure 3:
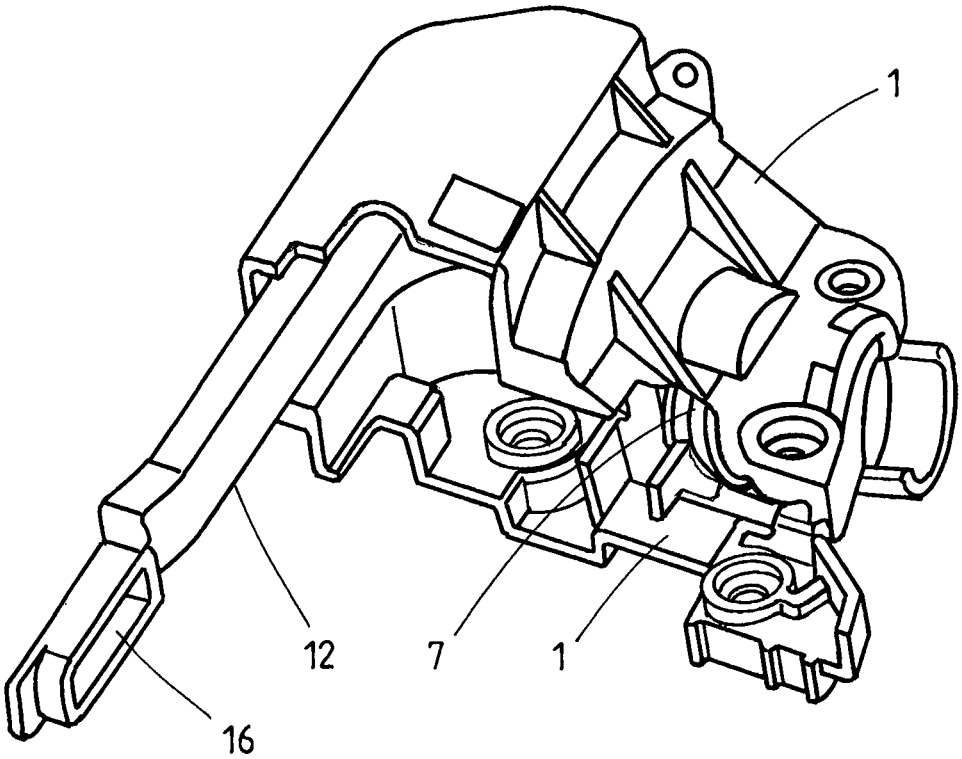
FIG. 3 is a perspective view of the FIG. 1 locking module showing the complete housing.
Figure 4:
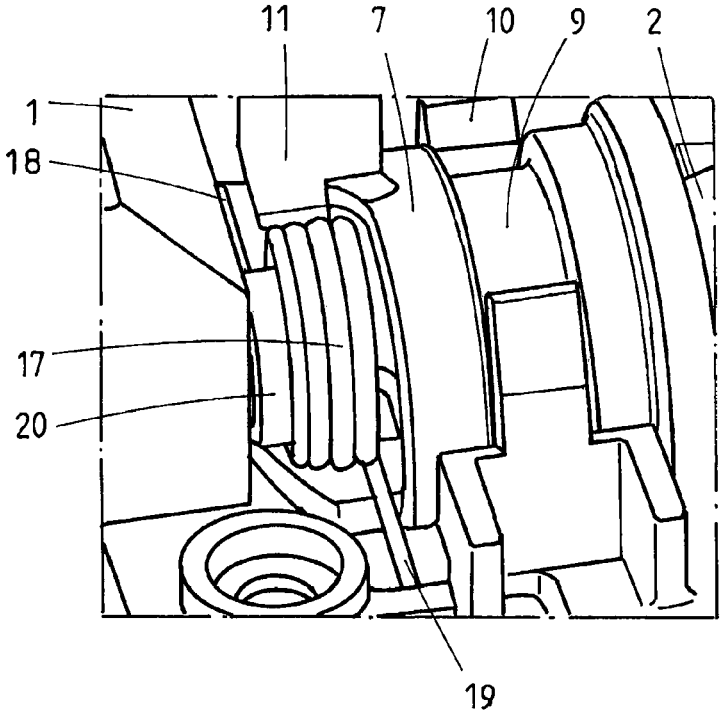
FIG. 4 is a perspective view of a portion of the FIG. 1 locking module.
Figure 5:
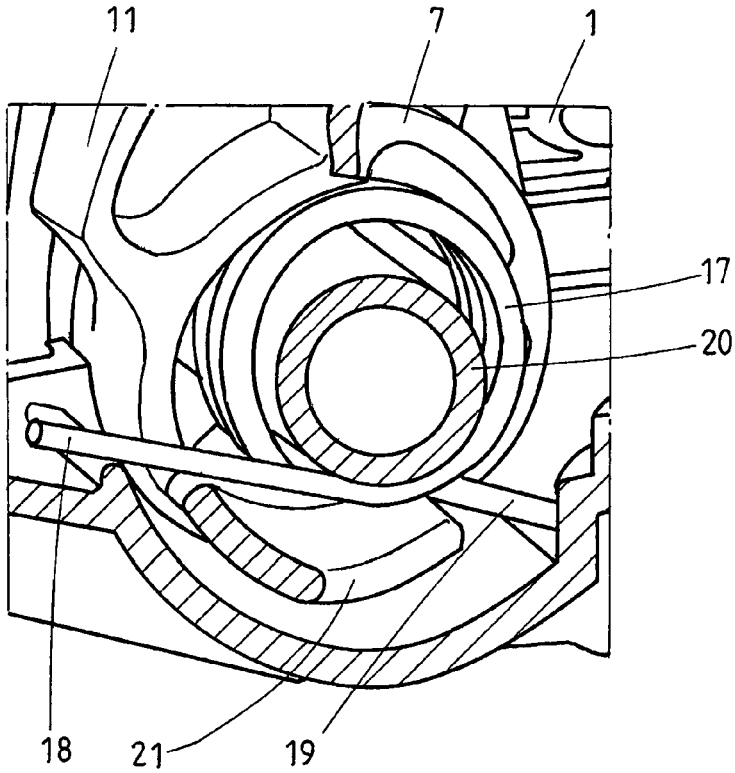
FIG. 5 is a cross-sectional view of a portion of the FIG. 1 locking module.

The end of the dog 12 protruding from the housing 1 can contain a slotted hole 16 as shown in FIG. 3, ensuring that internal actuation of the lock from the inside of the motor vehicle can function independently from an external actuation. The slotted hole could be omitted, but in this case when opening the door using the internal actuation, the dog and transmission lever would be moved as well, which in turn would result in a more difficult actuation. More friction would have to be overcome and more components would have to be moved. FIG. 3 also shows a second shell of housing 1 which is independent in this embodiment As shown in FIGS. 4 and 5, the module can contain a leg spring 17, ensuring that the transmission lever 7 is returned to a centre position after pivoting. The leg spring 17 can be held by a shaft 20 of the transmission lever 7. The two legs 18 and 19 of the leg spring 17 abut on one hand against the housing 1 in such a way that they can be deflected by respective pivoting of the transmission lever 7 by means of a partially circular element 21 of the transmission lever 7 and, in particular, against a pretensioned spring 17. As soon as no or no adequate force for pivoting is exerted on the transmission lever 7, spring 17 ensures that the transmission lever 7 is returned to the position shown in FIG. 5, i.e. the insertion position or zero position.

LIST OF REFERENCE NUMBERS

1. Housing
2. Switching nut
3. Ring-like protruding area
4. Ring-like extending groove
5. Ring-like area for accommodating the switching nut
6. Area for a rotatable mounting of the switching nut
7. Transmission lever
8. Opening extending into the transmission lever
9. Circumferential groove in the external surface of the transmission lever
10. Housing area, extending into a groove of the transmission lever
11. Lever of the transmission lever
12. Dog
13. Stop of transmission lever
14. Stop of transmission lever
15. Mounting unit in module housing
16. Slotted hole of dog
17. Leg spring
18. Leg of leg spring
19. Leg of leg spring
20. Axis for mounting of leg spring
21. Protruding element of transmission lever

The invention claimed is:

1. Locking module comprising a housing, a switching nut that can be connected to a locking cylinder so as to rotate the switching nut by means of a key and a mechanism for converting a rotary movement of the switching nut into a linear movement of a dog for locking and unlocking a lock, characterized in that the switching nut is rotatably mounted by the housing and a leg spring is provided, which after a rotation of the switching nut returns a transmission lever, moveable by the switching nut, to an interim position and, wherein the leg spring includes a first leg that abuts the housing and a second leg that can be deflected by pivoting of the transmission lever to bias the spring between the housing and the transmission lever, wherein one of the switching nut or the housing include a first protuberance that extends into a mating first groove defined in the other of the housing or the switching nut, and wherein the mating first protuberance and first groove permit the switching nut to rotate relative to the housing while securing the switching nut from moving relative to the housing.

2. Locking module according to claim 1, wherein the transmission lever transmits the movement of the switching nut to the dog.

3. Locking module according to claim 2, characterized in that an axis of rotation of the switching nut and an axis of rotation of the transmission lever are arranged at an angle smaller than 180°.

4. Locking module according to claim 2, characterized in that a lateral surface of the transmission lever extends into a lateral surface of the switching nut and vice versa, with both lateral surfaces containing stops in such a way that a stop of the switching nut can be moved against a stop of the transmission lever by rotating the switching nut.

5. Locking module in particular according to claim 2, wherein the switching nut and the transmission lever are completely arranged within the housing.

6. Locking module according to claim 2, characterized in that a neutral position is provided, able to transmit a movement of the switching nut onto the dog after a delay.

7. Locking module according to claim 6, characterized in that the neutral position is at least 20° and preferably at least 25°.

8. Locking module according to claim 6, characterized in that the neutral position between the transmission lever and the switching nut is provided.

9. Locking module according to claim 8, characterized in that a lateral surface of the transmission lever extends into a lateral surface of the switching nut and vice versa, with both lateral surfaces containing stops in such a way that a stop of the switching nut can be moved against a stop of the transmission lever by rotating the switching nut.

10. Locking module according to claim 9, characterized in that the neutral position is at least 20° and preferably at least 25°.

11. Locking module according to claim 1, characterized in that a transmission lever is rotatably mounted by the housing.

12. Locking module according claim 1, characterized in that the dog is displaceably mounted by the housing.

13. Locking module according to claim 1, characterized in that a neutral position is provided, able to transmit a movement of the switching nut onto the dog after a delay.

14. Locking module in particular according to claim 1, wherein the spring is pretensioned.

15. Locking module in particular according to claim 1, wherein the spring defines a central opening through which the transmission lever passes.

16. Locking module in particular according to claim 1, wherein the switching nut defines a cone-like tapered end that extends into an opening of the transmission lever.

17. Locking module in particular according to claim 16, wherein the switching nut and the transmission lever are not arranged parallel to each other.

18. Locking module comprising a housing, a switching nut that can be connected to a locking cylinder so as to rotate the switching nut by means of a key, a mechanism for converting a rotary movement of the switching nut into a linear movement of a dog for locking and unlocking a lock, and a transmission lever for transmitting the movement of the switching nut to the dog, characterized in that the switching nut is rotatably mounted by the housing wherein one of the switching nut or the housing include a first protuberance that extends into a mating first groove defined in the other of the housing or the switching nut, wherein the mating first protuberance and first groove permit the switching nut to rotate relative to the housing while securing the switching nut from moving relative to the housing, wherein the housing includes a second protuberance that extends into a mating second groove defined in the transmission lever, wherein the mating second protuberance and groove permit the transmission lever to rotate relative to the housing while securing the transmission lever from moving relative to the housing, and wherein the switching nut defines a cone-like tapered end that extends into an opening of the transmission lever.

19. Locking module in particular according to claim 18, wherein the switching nut and the transmission lever are not arranged parallel to each other.

20. Locking module in particular according to claim 18, wherein the switching nut and the transmission lever are completely arranged within the housing.

* * * * *